US006581803B1

(12) United States Patent
Yoshimoto et al.

(10) Patent No.: US 6,581,803 B1
(45) Date of Patent: Jun. 24, 2003

(54) DISCHARGING CONTAINER

(75) Inventors: Yukio Yoshimoto, Suita (JP); Masaharu Nakao, Otsu (JP)

(73) Assignee: Taisei Kako Co., Ltd., Osaka (JP)

( * ) Notice: Subject to any disclaimer, the term of this patent is extended or adjusted under 35 U.S.C. 154(b) by 0 days.

(21) Appl. No.: 09/868,372

(22) PCT Filed: Oct. 2, 2000

(86) PCT No.: PCT/JP00/06864

§ 371 (c)(1),
(2), (4) Date: Jun. 18, 2001

(87) PCT Pub. No.: WO01/38194

PCT Pub. Date: May 31, 2001

(30) Foreign Application Priority Data

Nov. 19, 1999 (JP) ..... 11-329120

(51) Int. Cl.[7] ..... B65D 35/56

(52) U.S. Cl. ..... 222/105; 222/106; 222/212; 222/386.5; 222/481.5

(58) Field of Search ..... 222/105, 106, 222/192, 212, 386.5, 481.5

(56) References Cited

U.S. PATENT DOCUMENTS

| | | | | | |
|---|---|---|---|---|---|
| 4,760,937 | A | * | 8/1988 | Evezich | 222/95 |
| 4,865,224 | A | * | 9/1989 | Streck | 222/95 |
| 5,275,311 | A | * | 1/1994 | Piarrat | 222/209 |
| 5,332,121 | A | * | 7/1994 | Schmidt et al. | 222/95 |
| 5,366,115 | A | * | 11/1994 | Kersten et al. | 222/105 |
| 5,388,727 | A | * | 2/1995 | Jouillat | 222/94 |
| 5,615,803 | A | * | 4/1997 | Hatakeyama et al. | 222/94 |

FOREIGN PATENT DOCUMENTS

| | | |
|---|---|---|
| JP | 10165222 | 6/1998 |
| JP | 10338269 | 12/1998 |
| JP | 200016470 | 1/2000 |

* cited by examiner

*Primary Examiner*—Joseph A. Kaufman
(74) *Attorney, Agent, or Firm*—Wood, Phillips, Katz, Clark & Mortimer

(57) ABSTRACT

A discharging container having outer and inner layers with an ambient air inlet formed solely in the outer layer without a valve. The inlet has an opening smaller than the opening of a discharging outlet mouth formed in a cap, so that the outer layer's body part may be squeezed to compress the air between the inner and outer layers, whereby the compressed air depresses the inner layer inwardly and radially to exude a liquid content outwards through the discharging outlet.

9 Claims, 14 Drawing Sheets

DISCHARGING CONTAINER

BACKGROUND OF THE INVENTION

The present invention relates to a discharging container comprising a laminated bottle that has a delaminatable inner layer on the inner surface of an outer layer and at least one ventilation hole to suck ambient air into a space between the inner and outer layers, wherein the container is adapted for use as a hair-dyeing tool or the like.

The Patent Laying-Open Gazette No. Hei. 4-267727 discloses a multi-layered container designed such that ambient air is inhibited from entering the container through a mouth while allowing its content to be discharged by the pumping action of an inner and outer layers. This container consists of a bottle and a cap, wherein the bottle is composed of an impermeable inner layer and a squeezable outer layer, with the cap being attached to the mouth part of the bottle. The inner layer can be readily delaminated from the outer layer in which at least one ventilation hole is formed such that the ambient air can communicate with a space between the layers. A check valve is incorporated in connection with the ventilation hole. The cap has a discharging outlet and a further check valve cooperating therewith.

Therefore, the inner layer will spontaneously shrivel as quantity of the content decreases, with the ambient air flowing into the space through the at least one ventilation hole so that only the outer layer can restore and always maintain its normal configuration. Its content remains satisfactory in quality, from the beginning to end of use, without being adversely affected by ambient air or external light beams.

The multi-layered container in the prior art has a film tag adhered in part to the rim of the ventilation hole, and a tag larger than the hole is disposed inside the outer layer so as to serve as a valve body in a ventilation valve. Such a kind of ventilation valve will allow air to flow only inwardly into the container from outside. When a user grips the container having a decreased amount of content left therein, the ventilation hole will be closed by the valve body due to an increasing inner pressure between the layers so as not to allow any amount of air to leak out from the interlayer space. Thus, such a depressed outer layer will compress air present between the layers, thereby causing the compressed interlayer air to press in a centripetal direction the inner layer to be capable of exuding the content out of the container to the very end.

The prior art method may comprise the steps of preliminarily blow molding or thermally forming the outer layer that has the ventilation hole formed therein, and subsequently integrating it with the inner layer. However, such a method requires so many steps as to raise manufacture cost of the discharging containers and lower yield thereof.

SUMMARY OF THE INVENTION

The present invention provides a discharging container having at least one ventilation hole but lacking any valve body in connection therewith, nevertheless allowing ambient air to flow into the interlayer space and ensuring exhaustion of the liquid content. Thus, the invention aims at simplifying the structure of the container and lowering its manufacture cost.

The discharging container of the present invention may comprise a laminated bottle having a mouth part and a cap fitting on the mouth part of the bottle. The laminated bottle may comprise of an outer layer and an inner layer laminated on an inner surface of the outer layer such as to be capable of delaminating from the outer layer, and the inner layer may be capable of being charged with a liquid content. The outer layer may have a body part capable of being deformed so as to deflate and recovering its undeformed normal configuration. At least one inlet may be formed in the outer layer to allow ambient air to flow into a space present between the outer layer and the inner layer while the deformed outer layer is recovering the normal configuration. The cap may have an outlet for discharging the liquid content out of the inner layer.

In the container of the invention, the inlet may always be kept open, and the inlet may have an opening area smaller than that of the discharging outlet such that an air in the space between the layers is compressed when the body part of the outer layer is deformed so as to deflate, whereby the liquid content is discharged out through the outlet as a result that the compressed air presses inwardly about a circumference of the inner layer. Owing to this feature wherein the ambient air inlet has such a small diameter, for instance about 0.1 to 0.5 mm, a rate at which the actual and varying internal capacity of the bottle's body part inner layer will be decreased is rendered higher than a flow rate of the interlayer air being discharged outwards, when squeezing the bottle's body part holding a reduced amount of liquid content left therein. The air between the inner and outer layers will consequently be compressed, and such compressed air causes the inner layer to further deform itself inwardly and centripetally so as to allow the liquid content to be squeezed out more smoothly through the cap's discharging outlet. This outlet has an opening area much larger than that of the ambient air inlet, whereby a flow resistance of the content flowing out through the outlet is much lower than that of the air flowing out through the inlet. In addition, the discharging outlet in usual cases may have a check valve in connection therewith in order to prevent the liquid content from flowing backwards. Preferably, this check valve is designed to open substantially without encountering any resistance.

Releasing the bottle after use, the outer layer will expand and restore its normal configuration due to its shape recovering property. In the course of such a change in shape, the space between the inner and outer layers will become larger and larger to produce a negative pressure. Consequently, the ambient air will gradually flow into the interlayer space through the ambient air inlet, until the negative pressure disappears.

Such a slow expansion and gentle recovery of natural statue of its outer layer body part after use to discharge the content, in contrast with quick deformation of said part when discharging the liquid content, will however scarcely hinder convenient usage of the container of this type. The present invention utilizing this advantage is capable of providing a simply constructed discharging container dispensed with any extra or additional valve.

The laminated bottle described above may be formed by blow molding such a laminated parison that the inner layer is preliminarily molded on the inner surface of the outer layer. It may be possible to employ, in place of this method, any other appropriate molding methods such as an injection-blow-molding. The body part of the laminated bottle may be depressed to deform itself radially and inwardly (to show the so-called "the squeezability"), or alternatively be depressed to deform itself in an axial direction if the outer layer body part is made to be of a spherical shape, a tubby beer-barrel shape or any other configuration. It is preferable, after preparation of the laminated bottle and before mounting a cap thereon, to evacuate the interior of the inner layer through the bottle mouth. This is for the purpose of facilitating the inner layer to delaminate readily from the outer layer during use. Also preferably, at least one ventilation hole whose opening is larger than that of the ambient air inlet may be formed in the outer layer, in order to smoothly introduce the external air into the interlayer space when evacuating the bottle as just mentioned above. After evacuation, compressed air will be blown inwardly through the bottle mouth so as to return the inner layer into its position sticking to the outer layer, before stopping the ventilation hole with a closing member. The bottle will then be filled with the liquid content poured through its mouth, and then putting the cap thereon to provide a bottle container of the present invention. The ventilation hole and/or the ambient air inlet may be formed by pricking the outer layer with an appropriate member such as a needle, pin or the like heated to a sufficiently high temperature, during evacuation of the bottle to shrivel its inner layer. Any other appropriate means may be used instead to form these openings solely in the outer layer.

The closing member may be a plug snugly fitted in the ventilation hole, or alternatively, the cap on the bottle mouth may act as the closing member.

Further, it also may be possible to form the ambient air inlet in the member closing the ventilation hole.

From another aspect, the discharging container of the present invention comprises a laminated bottle having a delaminatable inner layer laminated on the inner surface of an outer layer in such a manner as to be capable of exfoliation therefrom, and also comprises a cap detachably attached to the mouth part of the bottle. The cap has an outlet formed therein to discharge a liquid content held inside the inner layer. A body part of the bottle outer layer can squeeze itself and then restore its normal configuration, and a mouth part of the outer layer has at least one comparatively large ventilation hole formed therein. The cap may closely contact the mouth part of the bottle substantially all around expect for a clearance below the ventilation hole, the clearance being defined between the mouth part and the cap.

The clearance may have an opening area smaller than that of the discharging outlet such that an air in the space between the layers is compressed when the body part of the outer layer is deformed so as to deflate, whereby the liquid content is discharged out through the outlet as a result of the compressed air pressing inwardly a circumference of the inner layer. Also in this case, a compression rate per unit time of the internal capacity of the inner layer is rendered higher than a flow rate of the air being blown outwards from between the inner and outer layers through the clearance when squeezing the bottle's body part with a user's hand. The interlayer air thus compressed will depress and shrivel the inner layer so as to allow the liquid content to be squeezed out through the outlet. In the bottle of this type, the inner layer's bottom may comprise a flange engaging with the outer layer's bottom so as to firmly secure these bottoms to each other and prevent the inner layer's lower end portion from curling up. Preferably, the flange may be formed when injecting a molten resin to mold the inner layer, in such a manner that the resin dashes inwards through a hole previously formed in the closed bottom of the cylindrical outer layer.

The laminated bottle of the present invention may be connected at its mouth with a cap having a check valve therein, thus rendering the discharging container applicable to various uses. In detail, the discharging container comprises the laminated bottle whose outer layer's body part is capable of deflating and deforming itself and the cap fitted on the bottle's mouth. The cap has a discharging outlet formed therein to discharge a liquid content held within the inner layer, and the discharging outlet has a check valve disposed therein. The outer layer's body part may be of a cylindrical shape to deform itself radially and inwardly, or may be of a spherical shape, of a tubby beer-barrel shape or of any other shape that can be depressed down towards its bottom to axially deform itself.

The laminated bottle of the present invention may be formed by any appropriate method such as the injection molding technique or the blow molding technique. The direct-blow molding, the injection-stretch-blow molding or the like technique may be employed as the blow molding method. However, the injection-stretch-blow molding is preferable to ensure precision in the molded products.

DETAILED DESCRIPTION OF THE INVENTION

Figure 1:
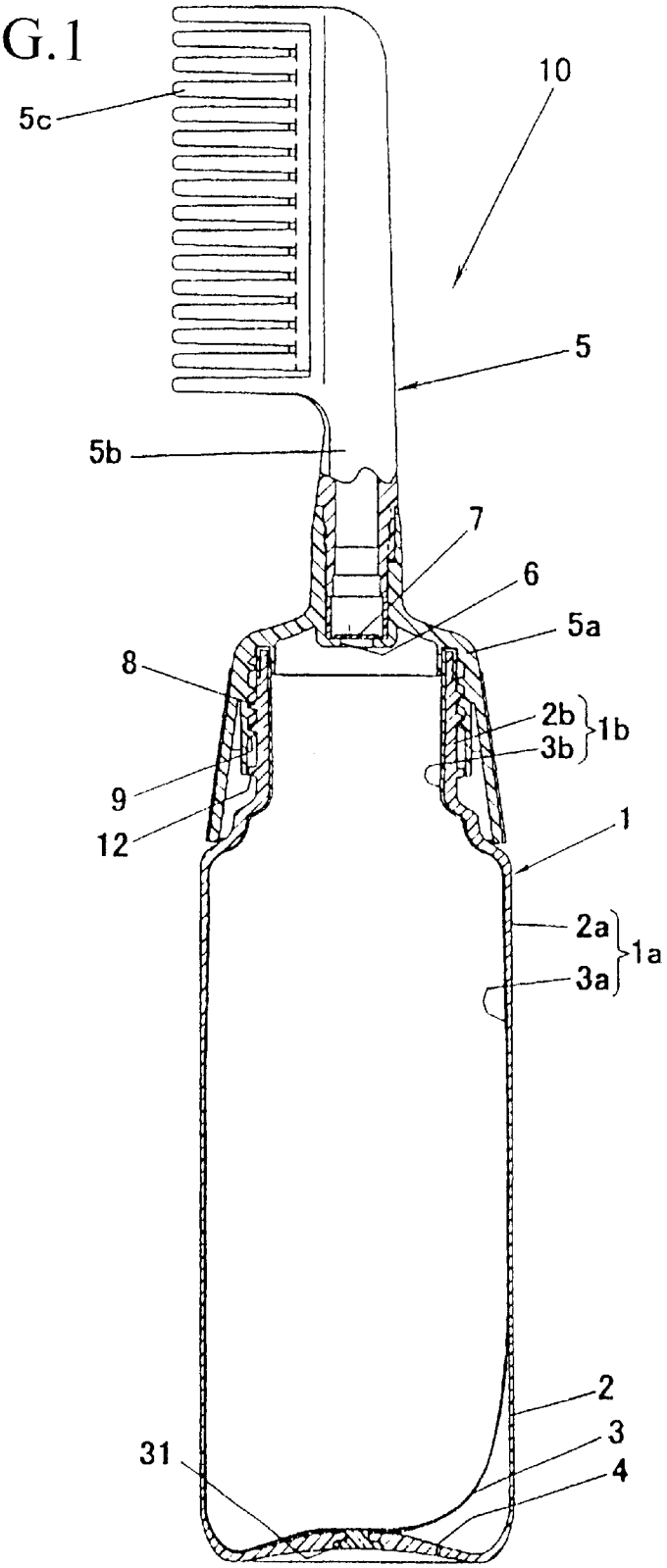
FIG. 1 is a vertical cross section of a discharging container provided in a first embodiment of the present invention and shown in its entirety.
Figure 2:
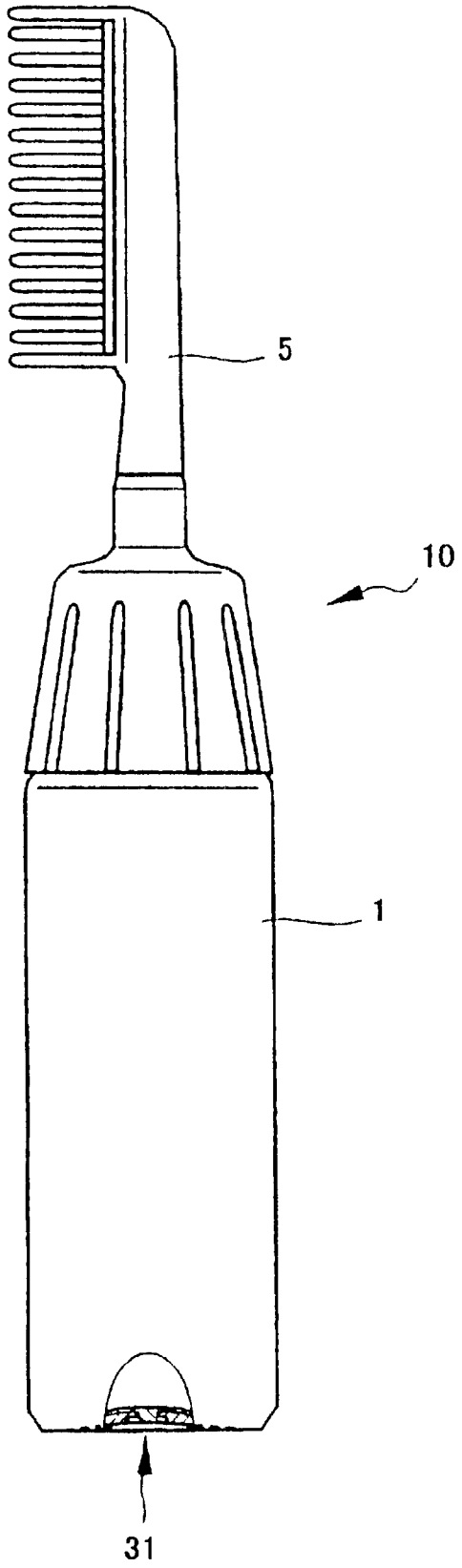
FIG. 2 is a front elevation of the discharging container shown in FIG. 1.

Now some preferred embodiments of the present invention will be described referring to the drawings, in order to make it more apparent.

FIGS. 1 to 4 show a discharging container 10 provided in a first embodiment, wherein this container including a laminated bottle 1 that has a closed bottom constitutes a comb-shaped product. The discharging container formed as the comb-shaped product 10 is suited for uniform application of its liquid content such as a hair-dye to human hair. When a user grips and presses a body part 1*a* of the bottle 1, it will deform to deflate itself so as to exude its liquid content through a passage extending through a comb-shaped cap 5. This content will thus flow out of one or more holes formed in proper portions of the comb. If the user stops gripping and pressing the bottle 1, it will expand and recover its normal configuration. Such a character of the laminated bottle 1 is called 'squeezability'.

The comb-shaped product 10 comprises the comb-shaped cap 5 fitted on a mouth part 1*b* of the bottle 1. This comb-shaped cap 5 is composed in turn of a cap portion 5*a* fitting on the mouth part 1*b* of the bottle, a stem 5*b* protruding from the top of cap portion 5*a* and a teeth portion 5*c* continuing from the stem 5*b*. The stem 5*b* is made hollow to communicate with the interior of the bottle through a discharging outlet 6 formed in the cap portion 5*a*. A check valve 7 is disposed in the discharging outlet 6, which valve on one occasion during use will allow the liquid content to flow out of the bottle into the comb-shaped cap 5, but on the other occasion prevents the content from flowing back into the bottle.

Figure 3:
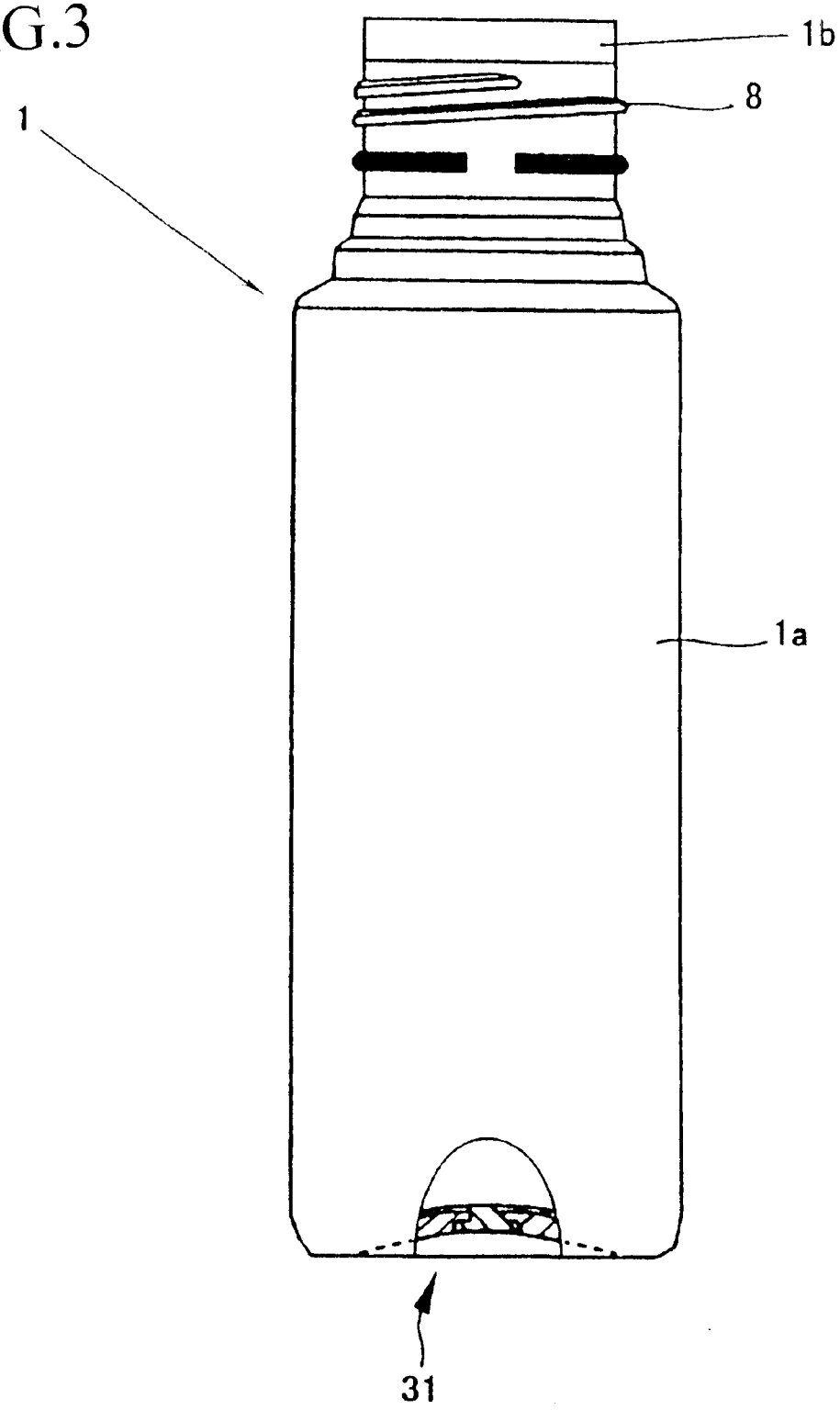
FIG. 3 is a front elevation of a laminated bottle included in the discharging container shown in FIG. 1, wherein a comb-shaped cap is removed therefrom.

As shown in FIG. 3, the bottle 1 has a threaded portion 8 formed integral with its outer periphery around the mouth part 1*b*. This threaded 5 portion 8 is to be fastened into a mating threaded portion 9 that is formed in the inner periphery of the cap portion 5*a*, to thereby fix the comb-shaped cap 5 on the bottle 1. An outer layer 2 of the laminated bottle 1 has a round and minute ambient air inlet 4 formed in its bottom. This ambient air inlet 4 will allow an external or ambient air to flow in between an inner layer 3 and the outer layer 2 of the bottle 1.

Figure 4:
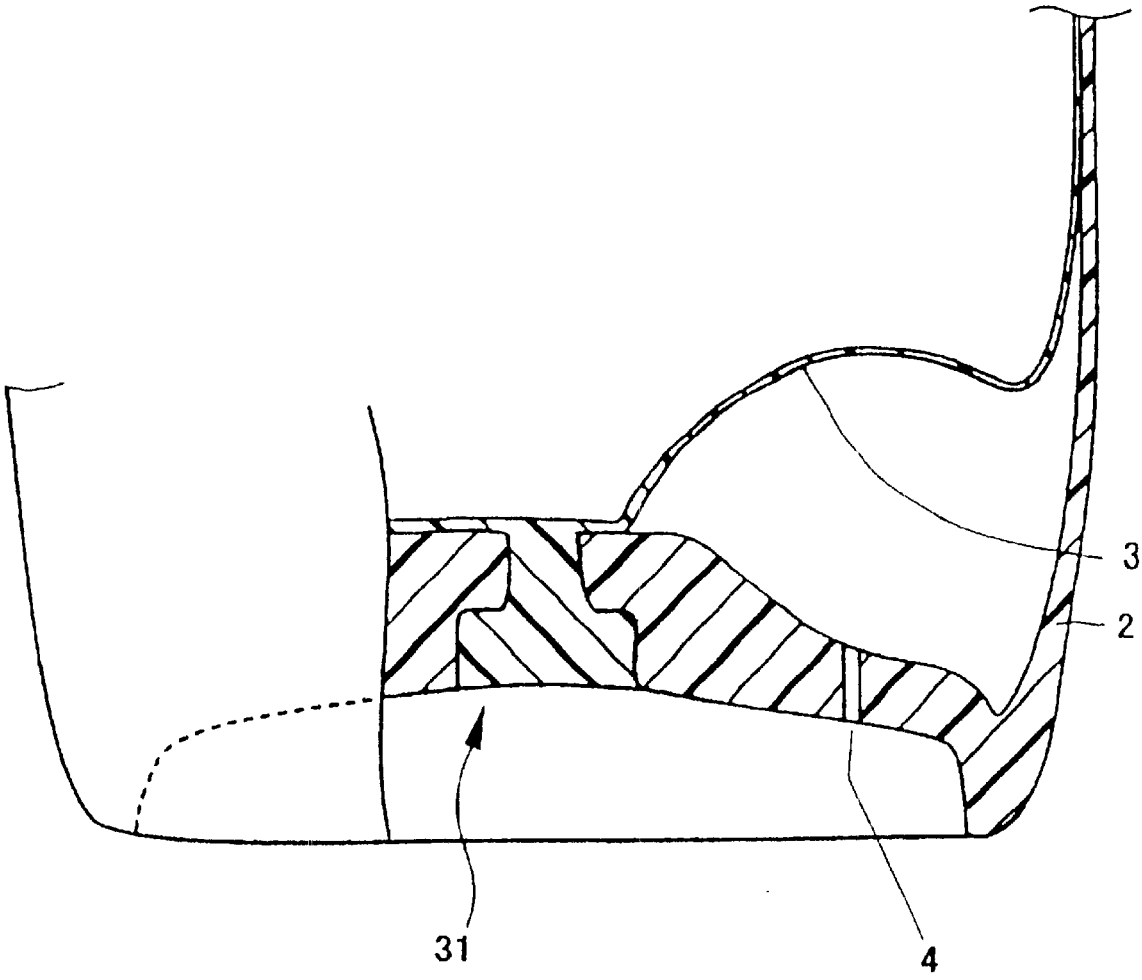
FIG. 4 is an enlarged cross section of a bottom portion of the laminated bottle shown in FIG. 3.

As seen in FIGS. 1 and 4, the laminated bottle 1 is composed of the outer layer 2 and the inner layer 3 formed therein. Those outer and inner layers 2 and 3 comprise cylindrical body parts 2*a* and 3*a* and cylindrical mouth parts 2*b* and 3*b*, respectively. In other words, the bottle's body part 1*a* consists of the outer and inner body parts 2*a* and 3*a*, with the mouth part 1*b* of the bottle likewise consisting of such outer and inner mouth parts 2*b* and 3*b*. The outer layer 2 may be made of a PET (viz., polyethylene terephthalate), an EVOH (viz., a copolymer of ethylene and vinyl alcohol) or the like resin. The inner layer 3 is a film prone to exfoliate from the outer layer 2 and capable of deformation relative thereto. A material for forming the inner layer 3 may be a polyolefin resin (such as a polyethylene) of an excellent gas-barrier property. The ambient air inlet 4, that is not formed in the inner layer 3, does penetrate the outer layer 2 from its outer surface to inner surface. The ambient air inlet 4 is arranged so as to not be closed with the comb-shaped cap 5 or any other constituent members.

The ambient air inlet 4 is designed to preferably have a diameter of 0.1 to 0.3 mm, more preferably of about 0.2 mm so as to restrict air flow therethrough at a considerably low rate. Although this inlet 4 can be formed in any appropriate portion of the outer layer's body part (for instance, in a peripheral wall thereof), it is desirable to dispose it in the bottom in order to afford a good appearance.

The valve body 7 (viz., the check valve) formed adjacent to the discharging outlet of the cap 5 faces the mouth part 1*b* of the laminated bottle 1. This valve body 7 will open without any resistance when the content of the inner layer 3 flows outwards into the comb-shaped cap 5, but will prevent any amount of content from returning back into the inner layer 3. The discharging outlet 6 has a diameter much larger than the that of the ambient air inlet 4, so that a sufficient amount of the liquid content will be exuded out through said outlet 6 as the internal pressure of the bottle is caused to increase.

The inner layer body part 3*a* is made so thin, for example about 0.2 mm in wall thickness, as to readily deflate and deform itself as the liquid content is gradually discharged. The outer layer body part 2*a* is squeezable smoothly and readily, and has a wall thickness of about 0.6 mm and an outer diameter of about 45 mm. The outer layer mouth part 2*b* has a greater thickness of about 1.5–2.5 mm so as to be rigid enough to hold the cap 5 thereon.

A flange 31 formed in a central bottom portion of the inner layer 3 firmly engages with a corresponding central bottom portion of the outer layer 2. This flange 31 is made of the same resin as the inner layer 3 to be integral therewith.

In use of the discharging container 10 described above, a user will grip and depress the body part 1*a* of the laminated bottle 1. This operation causes the outer and inner body parts 2*a* and 3*a* to deform themselves inwardly in a radial direction. Thus, the liquid content held in the inner layer 3 will be compressed to open the valve 7 and flow out through the discharging outlet 6 into the comb-shaped cap 5. If the user stops gripping and depressing the laminated bottle 1, then ambient air will gradually flow in through the ambient air inlet 4, into a space defined between the inner and outer layers. The outer layer 2 is thus allowed to expand and recover its normal configuration, whilst the inner layer 3 remains depressed due to the check valve 7 being closed. Such a closed check valve 7 prevents both the liquid content and the ambient air from returning into the inner layer 3. As the outer layer 2 gradually restores its natural configuration as just mentioned above, a negative pressure will appear in the space between the outer and inner layer body parts 2*a* and 3*a*. Consequently, an amount of ambient air is gradually sucked into this interlayer space between said layers 2 and 3 through the ambient air inlet 4.

Repetition of such a discharging of the liquid content will further reduce its quantity, until the inner layer 3 is delaminated almost completely apart the outer layer 2 to thereby produce a hollow and vacant space around the inner layer 3. If the user again grips the laminated bottle 1 and instantaneously depresses its body part 1*a*, the outer layer body part 2*a* will deflate to compress in turn the interlayer air present between it and the inner layer. It is to be noted here that the thus compressed internal air can flow out through the ambient air inlet 4, but very slowly at an extremely low flow rate. Therefore, the compressed air around the inner layer body part 3*a* will depress it in a centripetal direction to exude the liquid content outwards through the discharging outlet 6, well before the interlayer air completely escapes out through said inlet 4. Accordingly, the discharging container in this embodiment can operate to depress the interlayer air to exhaust its content, though there is no valve in its ambient air inlet 4. However, if the user stops gripping the bottle's barrel, the outer layer body part 2*a* will expand due to its elasticity so as to gently introduce therein the ambient air through the inlet 4, thus finally restoring its normal configuration.

Even if the liquid content is further discharged out of the container, its outer and inner layers 2 and 3 will remain firmly fixed to each other at their bottoms. Owing to this feature, the bottom end portion of the inner layer 3 will never curl up, while allowing the liquid content to be completely exhausted and enabling visual inspection of the interior of container to know from time to time how much content is left therein.

Figure 5:
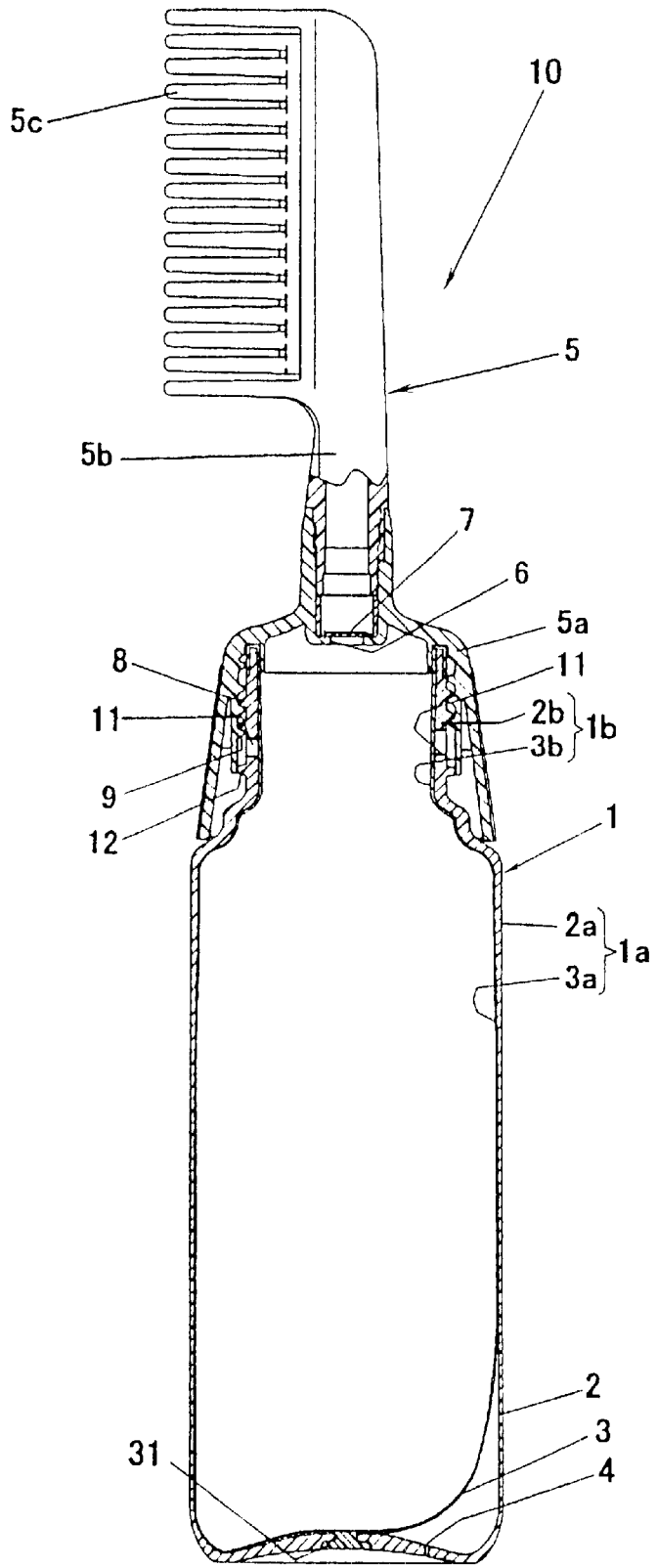
FIG. 5 is a vertical cross section of the discharging container provided in a second embodiment of the present invention and shown in its entirety.
Figure 6:
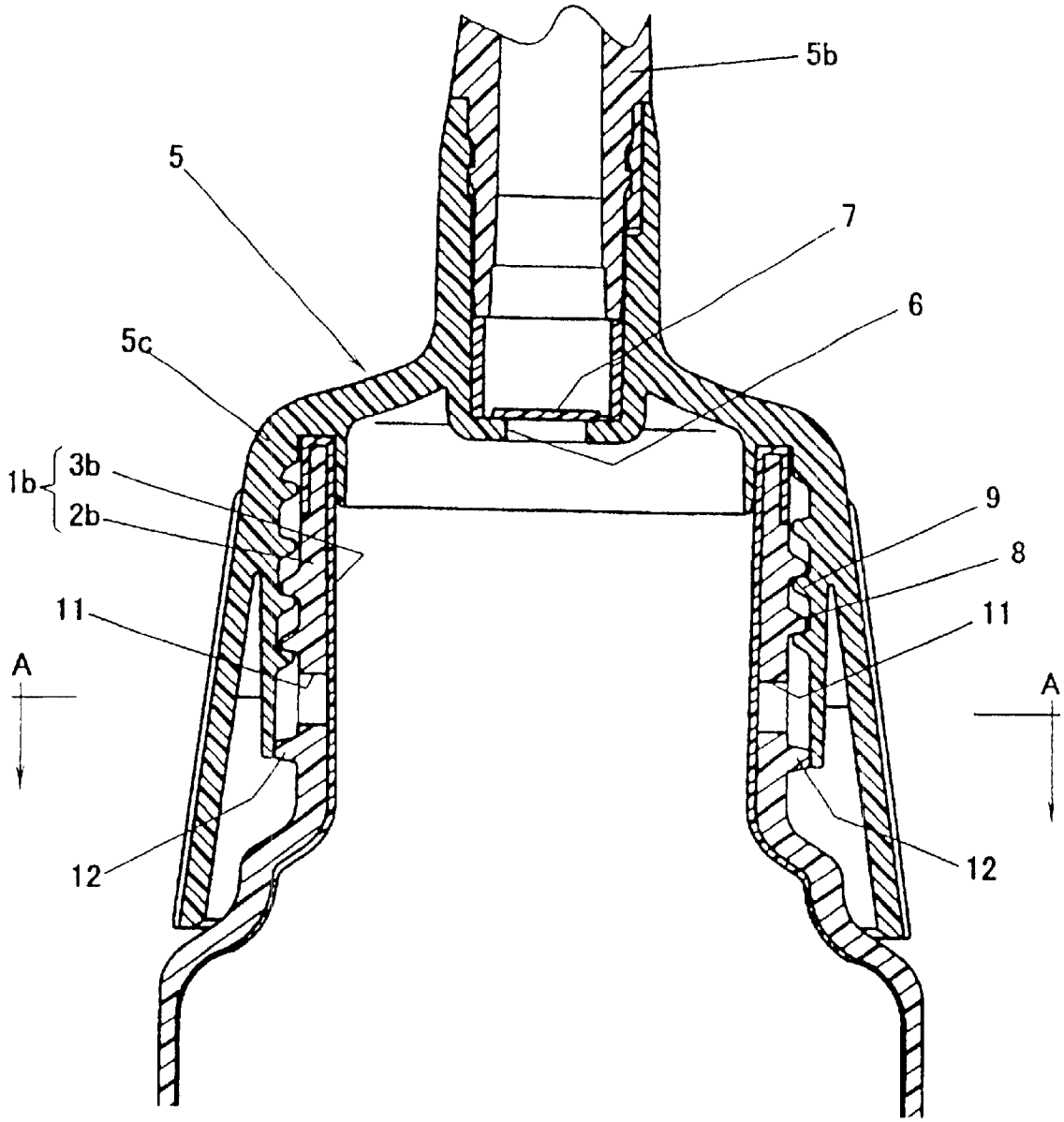
FIG. 6 is an enlarged vertical cross section of a mouth part of the discharging container shown in FIG. 5.
Figure 7:
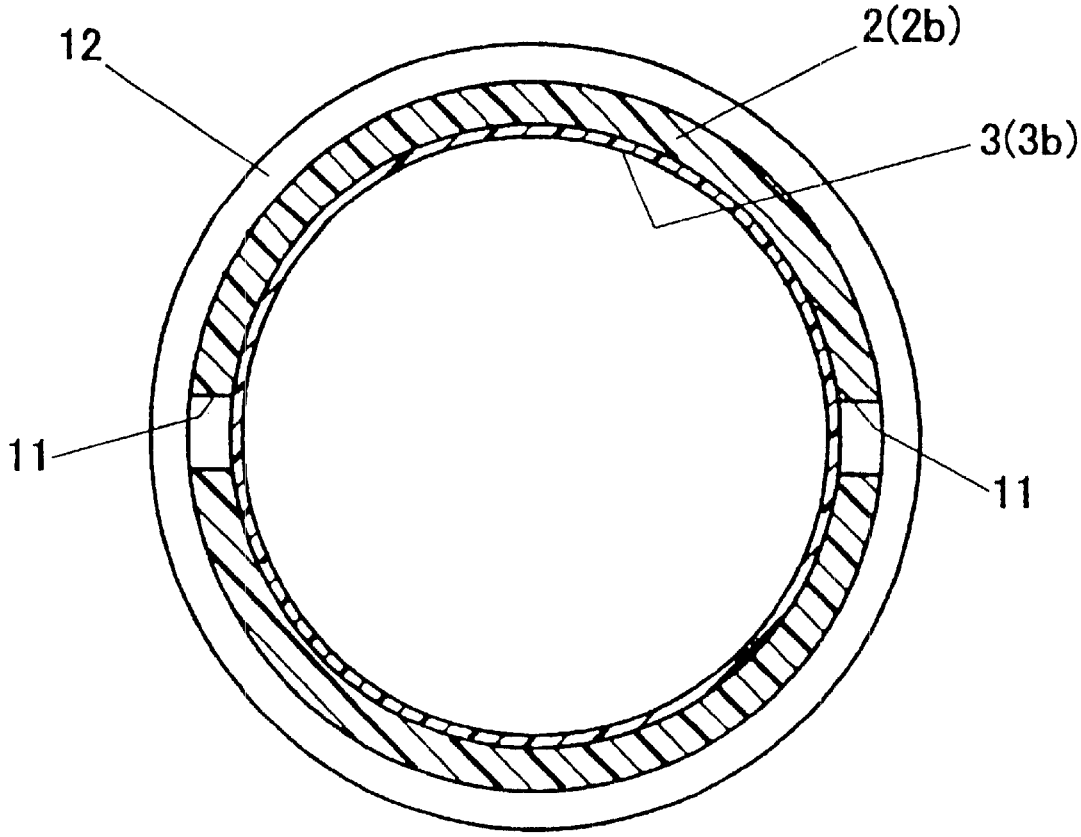
FIG. 7 is a cross section of a laminated bottle shown in FIG. 6, with the section being taken along the line A—A in FIG. 6.

FIGS. 5 to 7 show another discharging container 10 provided in a second embodiment. Description will be made here only to structural features and functions different from those in the first embodiment, by simply allotting the same reference numbers to the common or similar members.

The discharging container 10 of this embodiment has ventilation holes 11 having a diameter of ca. 2 to 5 mm and formed in the outer layer mouth part 2*b*. The ventilation holes are not formed in the inner layer 3 but only in the outer layer 2, in order to guide ambient air into the space between the outer and inner layers 2 and 3. The number of those holes 11 may be selected freely, and they may preferably be arranged at regular angular intervals.

The ventilation holes 11 are closed with the cap 5 fitted on the bottle's mouth part 1*b*. In detail, this mouth part 1*b* has a flange 12 radially and outwardly protruding below said holes 11. This flange 12 has a periphery normally kept in airtight contact with the inner periphery of the cap 5, so that the ventilation holes 11 are shut off from the ambient air. Owing to this feature, ambient air is prevented from flowing in through those holes 11 unless the cap 5 is taken off the bottle 1.

In addition to the functions and effects as provided in the first embodiment, the discharging container 10 of the second embodiment is advantageous as follows. In most cases, the inner layer 3 tends to stick to the outer layer 2 in such a fresh state that the laminated bottle 1 composed of the layers has been formed by injection-blow molding or the like appropriate methods. It is often required to eliminate such a sticking tendency that hinders the inner layer 3 from surely delaminating from the outer layer 2 during use. For this purpose, the laminated bottle 1 just blow molded may preferably be evacuated to forcibly delaminate its inner layer 3 from outer layer 2. The ventilation holes 11 will serve to introduce a sufficient amount of ambient air into the interlayer space so that the step of forcibly peeling the inner layer off the outer layer may be completed smoothly and quickly. Subsequent to this step, the cap 5 will be fitted on the bottle 1 to shut such ventilation holes 11, thus allowing the ambient air inlet 4 to continue to moderately control the outward and inward air streams through it. The cap 5 normally shutting the ventilation holes 11 makes it unnecessary to provide any discrete closing member, thus decreasing the number of necessary parts and lowering manufacture cost.

Figure 8:
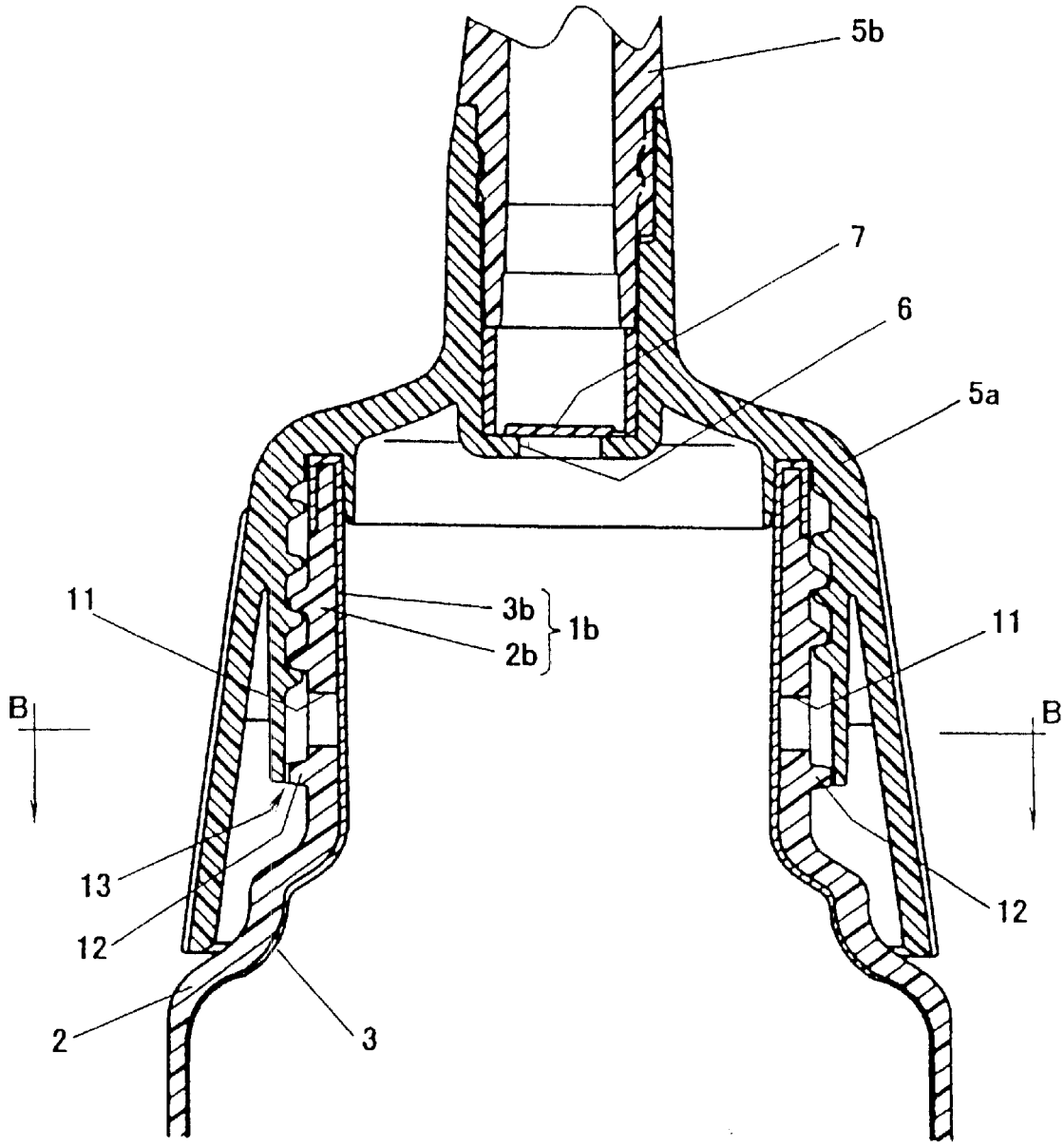
FIG. 8 is an enlarged vertical cross section of the discharging container's mouth provided in a third embodiment of the present invention.
Figure 9:
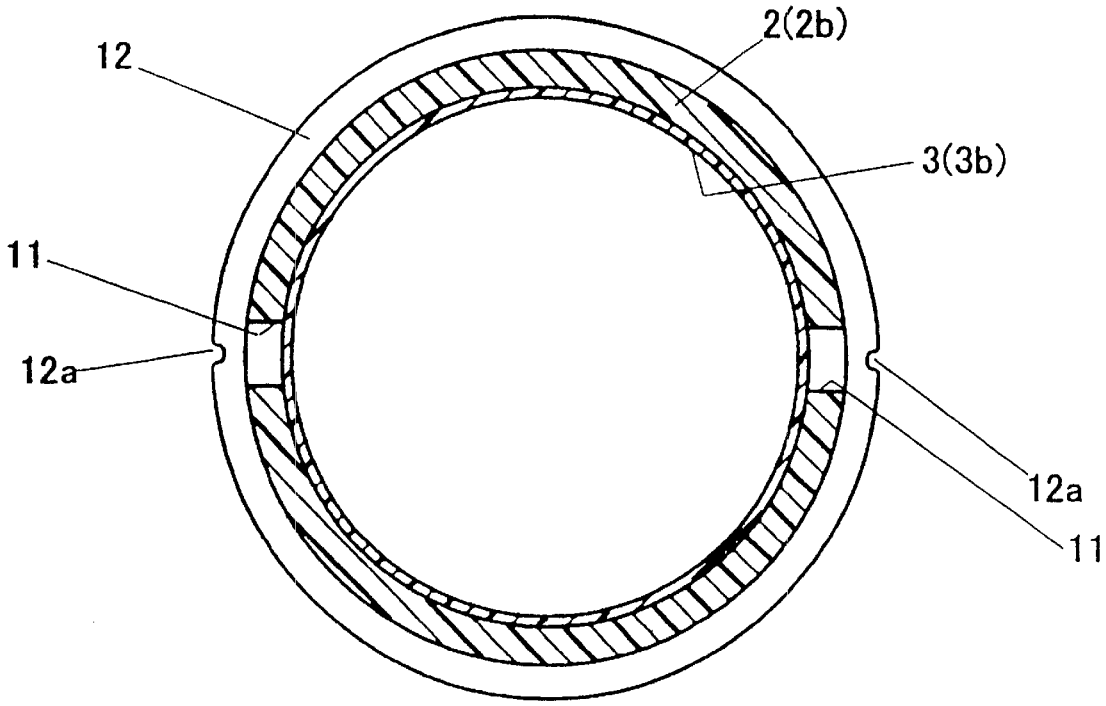
FIG. 9 is a cross section of the mouth part of a laminated bottle shown in FIG. 8, with the section being taken along the line B—B in FIG. 8.

FIGS. 8 and 9 show a further discharging container 10 provided in a third embodiment. Description will be made here only to structural features and functions different from those in the foregoing embodiments, also by simply allotting the same reference numbers to the common or similar members.

Though not illustrated clearly in the drawings, the laminated bottle 1 in the third embodiment does not have any ambient air inlet in the outer layer 2 of the bottle, in contrast with the first and second embodiments. In place of the ambient air inlet, the present embodiment provides a fine interstice or clearance 13. This clearance is disposed outside the ventilation holes 11 so as to control the rate of air flow in a manner described in the foregoing embodiments. A discharging container 10 of the present embodiment comprises a laminated bottle 1 having an inner layer 3 formed in and delaminatable from the outer layer 2, and a cap 5 fitting on the mouth part 1*b* of the bottle 1. The cap has a discharging outlet 6 to discharge a liquid content stored in the inner layer 3. The outer layer 2 comprises a body part 2*a* capable of deflating itself and expanding itself to restore its normal configuration. The mouth part 2*b* of the outer layer has the comparatively large ventilation holes 11 formed therein. A flange 12 is formed integral with the bottle's mouth part 1*b* and below the ventilation holes 11. The cap 5 is kept in an airtight contact with the flange, almost all around its inner periphery except for the clearance 13 that is arranged at proper circumferential regions around the mouth part 1*b*.

The clearance 13 has a cross-sectional opening area that is designed much smaller than that of the discharging outlet 6 so that the air between the outer and inner layers 2 and 3 will be compressed when squeezing the outer layer body part 2*a*. Such an air pressure will consequently depress the inner layer 3 centripetally to discharge the liquid content through the discharging outlet 6 of the cap 5. The clearance 13 is provided in the illustrated embodiment as two fine cutouts 12*a* that are formed diagonally in the flange 12 of the mouth part 1*b* of the bottle. Alternatively, fine recesses formed in the inner periphery of the cap 5 may serve as the clearance.

Figure 10:
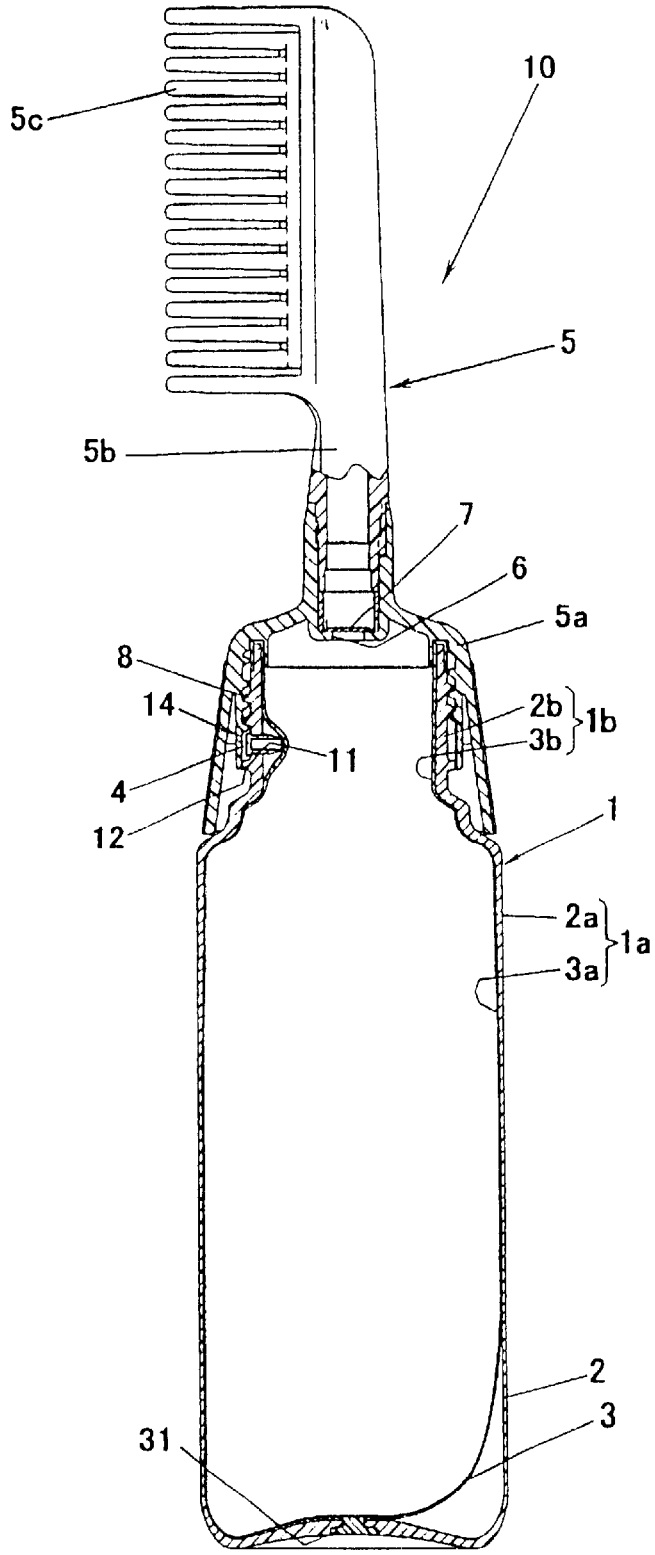
FIG. 10 is a vertical cross section of the discharging container provided in a fourth embodiment of the present invention and shown in its entirety.
Figure 11:
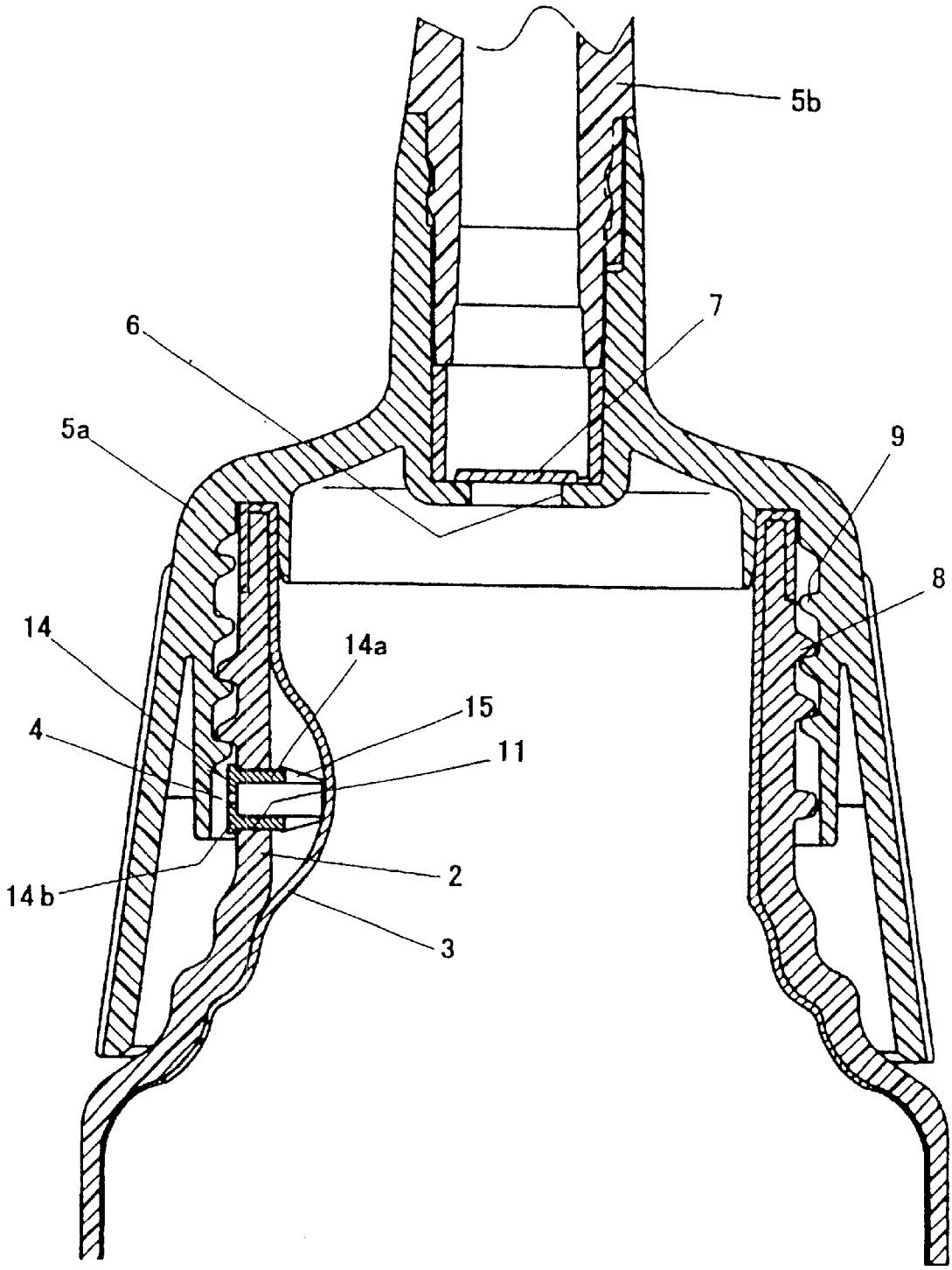
FIG. 11 is an enlarged vertical cross section of a mouth part of the discharging container shown in FIG. 10.

FIGS. 10 and 11 show a still further discharging container 10 provided in a fourth embodiment. Description will be made also only on structural features and functions different from those in the foregoing embodiments, by simply allotting the same reference numbers to the common or similar members.

Figure 12:
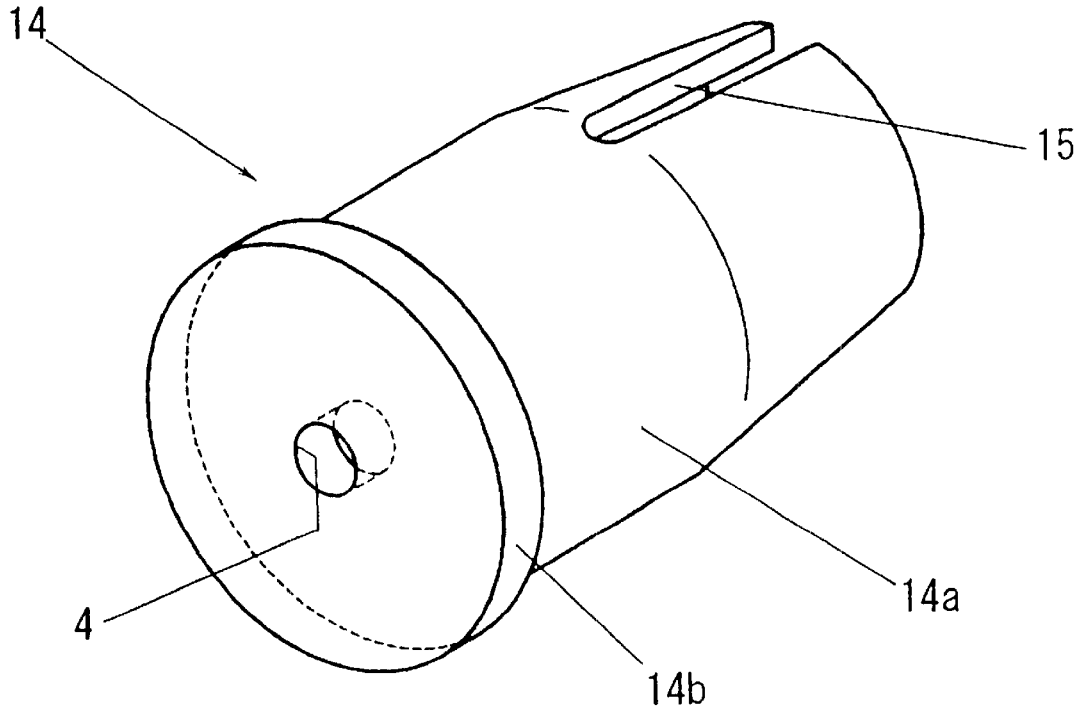
FIG. 12 is a perspective view of a plug-shaped eyelet to fit in a ventilation hole that is formed in the discharging container shown in FIG. 10.

In this embodiment, an ambient air inlet 4 for allowing the ambient air to enter the space between an inner and outer layers during use is formed in and through a plug-shaped eyelet 14 (as a closing member). This eyelet 14 fits in a ventilation hole 11 of the bottle's outer layer 2. As shown in FIG. 12, the plug-shaped eyelet 14 is composed of a generally cylindrical body 14*a* inserted in the hole 11 and an end plate 14*b* integrally closing the outer one of opposite ends of said body. A round and minute hole serving as the ambient air inlet 4 is formed in and through the end plate 14*b*. The eyelet body 14*a* has a length greater than the wall thickness of the outer layer's mouth part 2*b*. The inner end of the body 14*a* fitted in the ventilation hole 11 will bias a portion of the inner layer 3 towards a longitudinal axis thereof, as shown in FIG. 11. A local hollow space thus produced preliminarily between the outer and inner layers 2 and 3 will facilitate entrance of external air into the interlayer space through the round and minute hole 4. Further, at least one slit 15 is formed in the eyelet body 14*a* longitudinally thereof, affording communication of the interior of this body 14*a* with the interlayer space.

Figure 13:
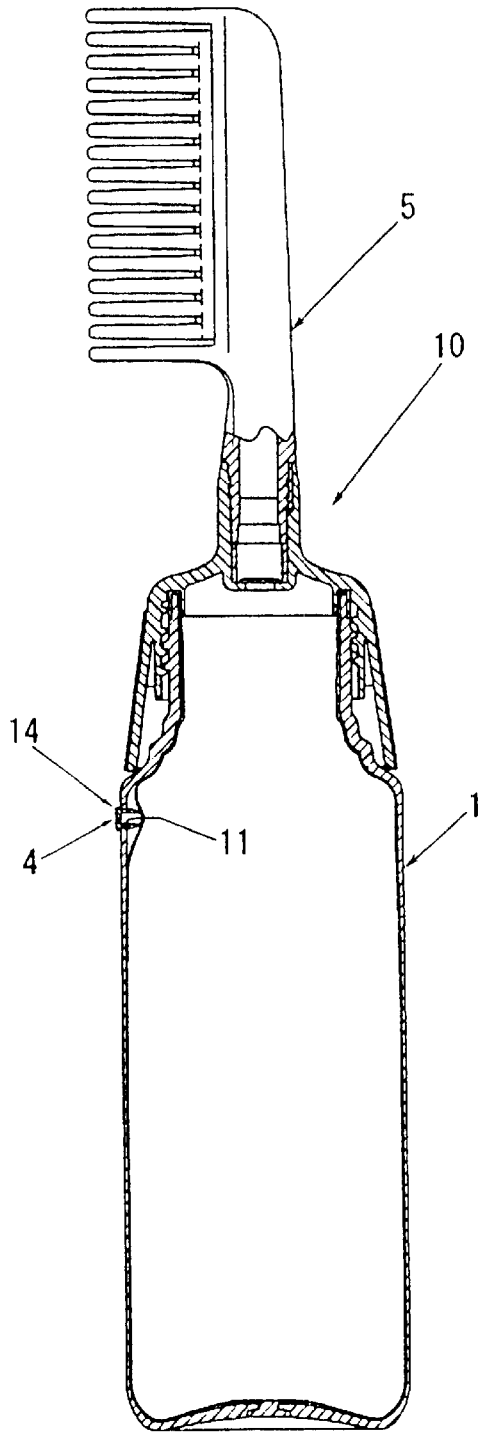
FIG. 13 is a vertical cross section of the discharging container provided in a fifth embodiment of the present invention and also shown in its entirety.
Figure 14:
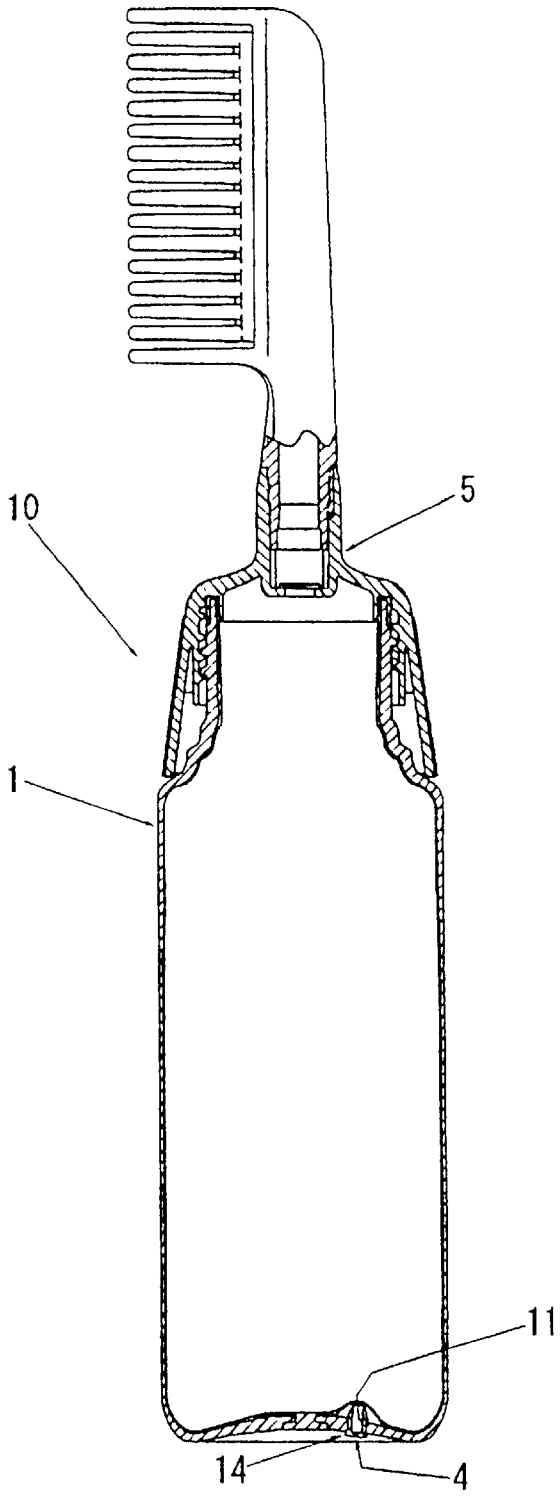
FIG. 14 is a vertical cross section of the discharging container provided in a sixth embodiment of the present invention and shown in its entirety.

Alternatively, the at least one ventilation hole 11 combined with the plug-shaped eyelet 14 may be formed in the bottle's body part '1*a*' as shown in FIG. 13, or in a bottom of the bottle as shown in FIG. 14.

The present invention is never limited to the illustrated embodiments but may be modified in any appropriate manners or fashions. For instance, the outer and/or inner layers constituting the laminated bottle may further be composed each of a plurality of sub-layers and strata. Although in the described embodiments the laminated bottle has a radially squeezable body part, it may alternatively be shaped into a sphere or a tubby beer-barrel to be depressed towards to its bottom in axial direction. Also, only one ambient air inlet has been illustrated hereinbefore, but any appropriate plurality thereof may be formed in the bottle without departing from the scope and spirit of the present invention.

What is claimed is:

1. A discharging container comprising:

a laminated bottle having a mouth part; and a cap fitting on the mouth part of the bottle, wherein the bottle comprises an outer layer and an inner layer laminated on an inner surface of the outer layer such as to be capable of delaminating from the outer layer;

the inner layer is capable of being charged with a liquid content;

the outer layer has a body part capable of being deformed so as to deflate and recovering its undeformed normal configuration;

at least one inlet is formed in the outer layer to allow ambient air to flow into a space present between the outer layer and the inner layer while the deformed outer layer is recovering the normal configuration, with no valve provided for said at least one inlet;

the cap has a discharging outlet for discharging the liquid content out of the inner layer; and the inlet has an opening area smaller than that of the discharging outlet such that air in the space between the layers is compressed when the body part of the outer layer is deformed so as to deflate, thereby the liquid content is discharged out through the outlet as a result that the compressed air presses inwardly a circumference of the inner layer.

2. A discharging container as defined in claim 1, wherein the outer layer has at least one ventilation hole formed therein whose opening area is larger than the inlet, the ventilation hole being normally closed with a closing member.

3. A discharging container as defined in claim 2, wherein the cap is the closing member.

4. A discharging container as defined in claim 1, wherein the discharging outlet has the opening area larger than that of the inlet, whereby a flow resistance of the content flowing out through the outlet is lower than that of the air flowing out through the inlet.

5. A discharging container as defined in claim 1, further comprising a check valve disposed in the discharging outlet.

6. A discharging container comprising:

a laminated bottle having a mouth part; and a cap fitting on the mouth part of the bottle, wherein the bottle comprises an outer layer and an inner layer laminated on an inner surface of the outer layer such as to be capable of delaminating from the outer layer;

the inner layer is capable of being charged with a liquid content;

the outer layer has a body part capable of being deformed so as to deflate and recovering its undeformed normal configuration;

at least one inlet is formed in the outer layer to allow ambient air to flow into a space present between the outer layer and the inner layer while the deformed outer layer is recovering the normal configuration, with no valve provided for said at least one inlet;

the cap has a discharging outlet for discharging the liquid content out of the inner layer;

the inlet has an opening area smaller than that of the discharging outlet such that air in the space between the layers is compressed when the body part of the outer layer is deformed so as to deflate, thereby the liquid content is discharged out through the outlet as a result that the compressed air presses inwardly a circumference of the inner layer; and the outer layer has at least one ventilation hole formed there with an open area larger than said at least one inlet, the ventilation hole being normally closed with a closing member having the ambient air inlet formed therein.

7. A discharging container comprising:

a laminated bottle having a mouth part; and a cap fitting on the mouth part of the bottle, wherein the bottle comprises an outer layer and an inner layer laminated on an inner surface of the outer layer;

the inner layer is capable of being charged with a liquid content;

the outer layer has a body part capable of being deformed so as to deflate and recover its undeformed normal configuration;

the outer layer has at least one ventilation hole formed in the mouth part;

the cap closely contacts the mouth part of the bottle substantially all around except for a clearance below the ventilation hole, the clearance defined between the mouth part and the cap;

the clearance has an opening area smaller than that of the discharging outlet such that air in the space between the layers is compressed when the body part of the outer layer is deformed so as to deflate, thereby the liquid content is discharged out through the outlet as a result such that the compressed air presses inwardly a circumference of the inner layer.

8. A discharging container as defined in claim 7, wherein a flow resistance of the content flowing out through the outlet is lower than that of the air flowing out through the clearance.

9. A discharging container as defined in claim 7, further comprising a check valve disposed in the discharging outlet.

* * * * *